United States Patent [19]

Yau

[11] Patent Number: 4,560,612

[45] Date of Patent: Dec. 24, 1985

[54] MAT BINDERS

[75] Inventor: Ben J. Yau, Reynoldsburg, Ohio

[73] Assignee: Owens-Corning Fiberglas Corporation, Toledo, Ohio

[21] Appl. No.: 610,902

[22] Filed: May 16, 1984

[51] Int. Cl.[4] ..... D04H 1/58; D04H 1/64; B32B 27/00; B32B 5/16

[52] U.S. Cl. ..... 428/288; 428/290; 524/512

[58] Field of Search ..... 428/288, 290; 524/512

[56] References Cited

U.S. PATENT DOCUMENTS

| | | | |
|---|---|---|---|
| 3,940,537 | 2/1976 | Burns | 428/288 |
| 4,258,098 | 3/1981 | Bondoc et al. | 428/290 |
| 4,324,833 | 4/1982 | Yau | 428/288 |
| 4,359,546 | 11/1982 | Bershas | 428/288 |
| 4,457,785 | 7/1984 | Hsu et al. | 106/308 N |
| 4,465,500 | 8/1984 | Motsinger et al. | 523/217 |

*Primary Examiner*—Herbert J. Lilling

*Attorney, Agent, or Firm*—Ronald C. Hudgens; Greg Dziegielewski; Debra L. Pawl

[57] ABSTRACT

A glass fiber binder consisting of a urea-formaldehyde resin, a styrene-butadiene latex copolymer and a fully methylated melamine-formaldehyde copolymer.

3 Claims, No Drawings

MAT BINDERS

TECHNICAL FIELD

This invention pertains to mat binders.

In one of its more specific aspects, this invention pertains to a binder which has improved moisture resistance and which is particularly suitable for the manufacture of roofing materials.

BACKGROUND OF THE INVENTION

Sized glass fibers maintained in a layered relationship by urea-formaldehyde binders and suitable for wet-laid, non-woven fibrous mat are well known. Such mats can be treated to manufacture roofing felts for shingles and built-up roof applications.

The admixture of urea-formaldehyde resins with styrene-butadiene latex copolymers and acrylamide type monomers to improve binder flexibility and moisture resistance in glass fiber mat has been disclosed in U.S. Pat. No. 4,258,098 to Bondoc et al.

There has now been invented an improvement of those binders in respect to moisture resistance.

This invention is directed to that improvement.

STATEMENT OF THE INVENTION

According to this invention, there is provided a glass fiber composition having a binder on the surface thereof, the binder consisting of a urea-formaldehyde resin, a carboxylated styrene-butadiene latex copolymer, and a fully methylated melamine-formaldehyde copolymer.

Also, according to this invention, there is provided a method of making a glass fiber mat which comprises binding glass fibers in the form of a mat employing the aforementioned binder composition.

Also, according to this invention, there is provided a substrate reinforced with the aforesaid glass fiber mat.

DESCRIPTION OF THE INVENTION

The composition of this invention can be employed with any glass fibers which can be formed into mats in any suitable manner. For example, for the purpose of producing roofing felts for shingles and built-up roof applications, sized fibers having lengths of from about 3 to about 51 mm in length and diameters of from about 6.5 to about 20 microns are preferably used. These fibers can be sized upon production and collected in any suitable manner including random dry distribution or dispersion in water and collection therefrom. Mats so formed can be of any desired thickness.

Any suitable urea-formaldehyde resin with good compatability with styrene-butadiene rubber can be employed. Suitable resins are commercially available as, for example, urea-formaldehyde resins modified with methylol groups which, upon curing form methylene or ether linkages. Such methylols can include N,N'-dimethyol, dihydroxymethylolethylene, N,N'-bis (methoxymethyl), N,N'-dimethylolpropylene, 5,5-dimethyl-N,N'-dimethylolpropylene, N,N'-dimethylolethylene, and the like.

One such urea-formaldehyde resin is 44TA21 available from Georgia Pacific. This material is a modified urea formaldehyde polymer in water solution with a specific gravity of 1.22 to 1.24 and a weight volatile percent of from 44 to 46 percent.

The urea-formaldehyde resin will comprise from about 20 to about 50 weight percent of the composition and, preferably, about 32 weight percent.

Any suitable carboxylated styrene-butadiene latex copolymer can be employed. Preferably, the latex copolymer will have a film forming temperature within the range of from about 20° to about 30° C.

One such styrene-butadiene latex is Dow Latex 485 available from Dow Chemical Co. It is an aqueous carboxylated styrene-butadiene copolymer latex having a film forming temperature of about 26° C. and a weight volatile percent of 54.

The styrene-butadiene copolymer will comprise from about 50 to about 80 weight percent of the composition and, preferably, about 61 weight percent.

Any suitable fully methylated melamine-formaldehyde copolymer can be employed. Suitable materials are liquid, fully methylated melamine-formaldehyde resins such as Cymel 303 from American Cyanamid. It is a liquid, fully methylated melamine-formaldehyde resin having a solution specific gravity of about 1.20, a Gardner-Holdt viscosity of $X-Z_2$ at 25° C. and a non-volatile percent of about 98.

The fully methylated melamine-formaldehyde resin will comprise from about 1 to about 14 weight percent of the mixture, preferably, about 7 weight percent.

The aqueous binder will be prepared by methods well-known in the art, water being employed to obtain a mix solids of about 30 weight percent with a defoamer and ammonia being employed, the latter to give a pH of the finished binder of about 6.0 to about 6.5.

A comparison of mat properties employing a fully methylated melamine-formaldehyde and a partially methylated melamine-formaldehyde is demonstrated by the following data.

Two binder formulations were prepared, one employing a fully methylated melamine-formaldehyde and one employing a partially methylated melamine-formaldehyde. Binder formulations were as follows:

| | Bonding Solids Ratio | |
|---|---|---|
| Component, Wgt. % | Formula I | Formula II |
| Urea-formaldehyde resin | 70.02 | 32 |
| Styrene-butadiene latex | 24.99 | 61 |
| Partially methylated M-F resin | 4.99 | 0 |
| Fully methylated M-F resin | 0 | 7 |
| Mat properties were as follows: | | |
| Mat Weight, #/100 ft.$^2$. | 2.20 | 2.40 |
| L.O.I., % | 20.1 | 24.1 |
| Dry Tensile, (#/in.) | 29 | 31 |
| Wet Tensile, (#/in.) Autoclaved | 6 | 26 |
| Wet Tensile/Dry Tensile, % | 21 | 84 |

In the above data, the wet tensile is determined on a sample of mat which has been subjected to steam autoclaving for a period of 24 hours.

These data indicate that while there is no significant difference in dry tensile strengths between the two formulations, there is a dramatic improvement in strength retention after autoclaving for the binder employing the fully methylated melamine-formaldehyde resin.

It will be evident from the foregoing that various modifications can be made to this invention. Such, however, are considered within the scope of the invention.

I claim:

1. A glass mat formed by glass fibers having on their surface a binder composition consisting essentially of a urea-formaldehyde resin, a styrene-butadiene latex copolymer and a fully methylated melamine-formaldehyde copolymer.

2. The glass mat of claim 1 wherein said urea-formaldehyde resin of the binder composition is present in an amount within the range of from about 20 to about 50 weight percent, said styrene-butadiene latex copolymer is present in an amount within the range of from about 50 to about 80 weight percent and said melamine-formaldehyde copolymer is present in an amount within the range of from about 1 to about 14 weight percent.

3. The glass mat of claim 1 wherein said urea-formaldehyde resin of the binder composition is present in an amount of about 32 weight percent, said styrene-butadiene latex copolymer in an amount of about 61 weight percent and said melamine-formaldehyde copolymer in an amount of about 7 weight percent.

* * * * *